United States Patent [19]

Wiley

[11] Patent Number: 4,891,918

[45] Date of Patent: Jan. 9, 1990

[54] COTTON BALE STORAGE

[75] Inventor: Jack A. Wiley, Lubbock, Tex.

[73] Assignee: Lov-Cot Industries, Incorporated, Lovington, N. Mex.

[21] Appl. No.: 121,234

[22] Filed: Nov. 16, 1987

[51] Int. Cl.[4] ..... B65D 71/00

[52] U.S. Cl. ..... 52/3; 52/DIG. 12; 150/154; 206/83.5; 47/28.1

[58] Field of Search ..... 52/3–5, 52/DIG. 12; 150/52 F, 52 E; 206/83.5, 442; 47/28, 17; 135/902

[56] References Cited

U.S. PATENT DOCUMENTS

| | | | |
|---|---|---|---|
| 179,976 | 7/1876 | Tuck et al. | 52/3 |
| 288,251 | 11/1883 | McComb et al. | 47/28 |
| 410,387 | 9/1889 | Walsh | 206/83.5 |
| 505,354 | 9/1893 | Garbesi | 47/28 |
| 608,042 | 7/1898 | Heath | 206/83.5 |
| 662,801 | 11/1900 | Munford | 206/83.5 |
| 1,020,169 | 3/1912 | Wallace | 135/87 X |
| 1,820,040 | 8/1931 | Zuckerman | 47/28 X |
| 3,360,884 | 1/1968 | Budd | 47/28 |
| 3,427,790 | 2/1969 | Flittie | 206/83.5 X |
| 3,498,305 | 3/1970 | Hulin | 135/902 |
| 3,674,139 | 7/1972 | Manasian et al. | 206/83.5 |
| 3,906,591 | 9/1975 | Boiardi | 206/83.5 X |
| 4,033,367 | 7/1977 | Johnston | 52/DIG. 12 |
| 4,712,672 | 12/1987 | Roy et al. | 52/3 X |

*Primary Examiner*—Richard E. Chilcot, Jr.
*Attorney, Agent, or Firm*—Wendell Coffee

[57] ABSTRACT

A fireproof, tapered, tubular cover with a sloping top is provided for a bale of cotton. The cover is stiff, tough, flexible, and water resistant. With the cover, the bale of cotton may be stored in an open yard.

12 Claims, 3 Drawing Sheets

COTTON BALE STORAGE

RIGHTS TO INVENTIONS UNDER FEDERAL RESEARCH:

There was no federally sponsored research and development concerning this invention.

BACKGROUND OF THE INVENTION:

(1) Field of the Invention

This invention relates to cotton bale storage. A cotton warehouse man is one having ordinary skill in this art.

(2) Description of the Related Art

Cotton is grown by cotton farmers. Different farmers may produce from 50 to 5,000 bales per year. The first step of moving the cotton to a cotton mill is to gin the cotton. After the lint is cleaned and removed from the seed, it is then compressed into bales which are basically rectangular cross sections, i.e., a rectangular prism. The bales normally will be wrapped in a fabric and tied with bands. Each bale will weigh about 500 pounds and have dimensions of about 20"×30"×54".

From the cotton gin, the bales of cotton are normally transported to a storage area customarily called a compress because in previous times, the bales of cotton were compressed at the compress to a smaller dimension than at the gin. The bales are stored at the compress, perhaps later moved to another warehouse, and eventually moved to the mills where the bales are broke open and the cotton is spun into yarn and woven into cloth. For many years, there would be a rather large supply of cotton at each location. i.e., at the cotton gin, the compress, the warehouse, and the mill. Because of the danger of fire and because of damage by weather deterioration, there is no baled cotton regularly stored at cotton gins at the present time.

In an effort to minimize expenses the mills attempt to carry as little inventory as possible. This minimum inventory is achieved by advanced accounting methods which include use of computers, so that the mills can anticipate with greater accuracy their usage of the cotton. Therefore, they depend upon transportation to have the cotton delivered to the mills as short of time as possible before its use.

Another factor involved with the movement of the cotton from the cotton gin to the mill is the great variety between bales of cotton. There are about 14 different grades which are based upon the color and trash content of the cotton. In addition to the grade, there are at least 8 staple lengths that are commonly used in commerce.

In addition to about 14 different grades and 8 different staples, cotton is also characterized by the fiber strength which is generally measured by the diameter of the fibers, commonly called the Micronaire. There are at least 4 categories by which this fiber strength might be commonly specified. i.e., any bale of cotton might be designated by each of the above into one of 448 different categories.

Of course, there may not be over 100 of these categories that are in sufficient volume to rate normal handling in the movement of the cotton from the gin to the mill. However, the cotton produced by any one cotton farmer might include bales in any of 10 or 20 different categories. Normally the mill will order cotton in lots of 100, basically in three or four closely related categories. Therefore, it is necessary, somewhere between the farm and the mill that there be certain concentrations of cotton.

Normally the person who concentrates the cotton (e.g., at the cotton compress) will not be the owner of the cotton. The cotton owner being either the cotton farmer, a cooperative of cotton farmers, the government through different farm programs, or individual cotton merchants who buy and sell cotton. The warehouse or compress will generally own none of the cotton it stores. Therefore, it is necessary that the warehouse be able to deliver bales of cotton which are owned by other people upon their orders when it is to be moved to another location.

While the cotton is in the custody of the warehouse, the warehouse must protect it against damage. The principal perils which they must guard against are fire for a total loss of the cotton or mildew or other damages resulting from prolonged moisture on the cotton. Therefore, the cotton is normally kept in warehouses having roofs to protect the cotton from weather and having elaborate fire precautions in the form of sprinkler systems.

The cost of warehousing cotton is expensive. The initial cost of the buildings and the sprinkler system and the piping and the like for these sprinkler systems are expensive. In addition, the buildings normally used to enclose the cotton are particularly subject to wind damage; and therefore, the insurance upon the buildings, because of the wind damage, is expensive. Even with the elaborate expensive precautions against fire, there is always the possibility of a loss of enormous amounts of cotton due to fire. Therefore, the insurance expense for the storage is of a substantial nature.

In addition, the amount of cotton produced in a region may vary considerably. In some years a region might produce twice as many bales as other times. e.g., within about 100 miles of Lubbock, Tex., the production in any one year might vary from 1,100,000 bales to 2,500,000 bales. It will be understood that during times of low cotton production and also if there is not a large amount of cotton held over from the prior years, the storage facilities would be very near empty. On the other hand, during years of high production, and particularly if there were an appreciable holdover from the past years, the storage facilities would be overflowing, i.e., often times the warehouses store cotton in the open with no protection from the weather and with only minimum fire protection.

Before this application was filed, the applicant was aware of the following United States patents:

| Inventor | U.S. Pat. No. |
|---|---|
| Glover | 263,695 |
| Grader | 281,490 |
| Lienhard | 1,599,826 |
| Hammett | 2,596,399 |
| Boiardi | 3,906,591 |
| Wright | 4,071,138 |
| Cunningham | 4,433,733 |

Applicant considers these patents, which generally show covers and the like, to be generally of interest to his invention.

SUMMARY OF THE INVENTION:

Progressive Contribution to the Art

I have invented an individual bale cover making it feasible to store cotton in open yards. This cover is made by spraying a filler material in the form of a slurry of aggregate, cement, and a polymer upon a form. This cover will be stiff but not inflexible; and therefore, self supporting. The cover will protect the cotton bale from fire and from water damage. Although the cover might not be absolutely waterproof, the amount of water which would seep through would be insufficient to cause damage to the cotton. Also, the cover being fireproof would not only prevent fire from a general area from igniting the enclosed bale of cotton, but it would also prevent sufficient air and oxygen from entering the enclosure, so that under normal circumstances, it would suffocate any fire which might be undetected when covering the bale of cotton.

It is contemplated that the cover could be made by forming a framework from expanded metal lathe and spraying the slurry through a nozzle similar to applying "Gunite". The covers might each have a loop on top so that they could be lifted by the loop onto a bale or removed from the bale.

One of the primary advantages of the cover is mobility to be moved from one cotton yard to another. Low cost would make it feasible for cotton to be stored upon the yards of cotton gins. As stated above, the concentration at cotton gins is now not feasible because of the investment in a shelter from the weather and fireproofing equipment, does not make a small storage facility feasible.

The reason it would be feasible to store cotton at the cotton gin, is primarily cost. It is estimated that the cost of storing a bale of cotton will be much lower according to my invention than according to present practices. First, the initial investment for the storage equipment would be about ⅔ the amount as in the present instance. i.e., the cost of the facilities to store an individual bale could be reduced by a substantial amount. In addition to this, the cost of insurance and the upkeep of the equipment to store individual bales would be less. According to my invention, there would be no elaborate sprinkler system, resulting in the mechanical or plumbing upkeep, and there would be no expensive structures subject to wind damage. Furthermore, because of the mobility of the equipment, there would not be the fixed cost of storage. "Fixed" indicating that it could be used to store cotton at only one location and could not be shifted according to the need and requirements in different years.

Objects of this Invention

An object of this invention are to protect a bale of cotton from fire and weather.

Another object of this invention is to provide storage facilities for cotton bales.

Further objects are to achieve the above with devices that are sturdy, compact, durable, lightweight, simple, safe, efficient, versatile, ecologically compatible, energy conserving, and reliable, yet inexpensive and easy to manufacture, use, and maintain.

Other objects are to achieve the above with a method that is rapid, versatile, ecologically compatible, energy conserving, efficient, and inexpensive, and does not require skilled people to use and maintain.

The specific nature of the invention, as well as other objects, uses, and advantages thereof, will clearly appear from the following description and from the accompanying drawing, the different views of which are not scale drawings.

Figure 1:
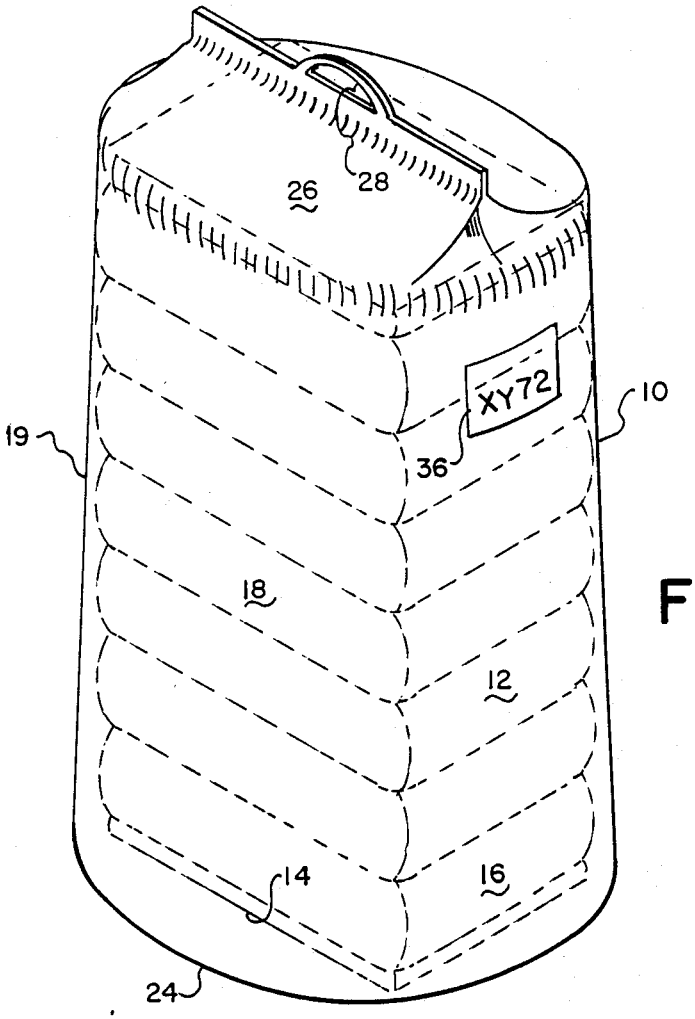
FIG. 1 is a perspective view of a cover according to this invention with the bale of cotton therein shown in phantom lines.

As an aid to correlating the terms of the claims to the exemplary drawing, the following catalog of elements and steps is provided:

| | |
|---|---|
| 10 cover | 26 cover top |
| 12 bale of cotton | 28 loop/lug |
| 14 bottom of bale | 30 bale vehicle |
| 16 narrow sides of bale | 32 rows |
| 18 wide sides of bale | 34 cover vehicle |
| 20 top of bale | 36 cover indicia |
| 22 support | 38 lathe |
| 24 cover open bottom | 40 filler material |

DESCRIPTION OF THE PREFERRED EMBODIMENT:

Referring to the drawing there may be seen cover 10 over bale of cotton 12. The bale of cotton is shown setting erect upon its bottom 14. The bale will have four sides which are designated as two narrow (20″) sides 16 and two wider (30″) sides 18. The bale will also have a top 20. There are different standard sizes of bales of cotton. However, at the present time, most bales are made to a size described as universal density (U.D.). The dimensions of a U.D. bale are 20″ thick, 30″ wide, and 54″ tall.

The major portion of the cover 10 will be a tube 19. Top 26 of the cover will be drawn together much like the end of a toothpaste tube. The tube will taper, being largest at its open bottom 24 and smaller at the cover top 26. It will be noted that the cover is shown in the drawings as having an elliptical cross section. An elliptical cross section is preferred because of ease of manufacture and use. However, the cross section of the cover could be circular, rectangular, or some nondescript shape. As may be seen, particularly referring to FIGS. 3 and 5, at the top 20 of the bale 12, the tube 19 will fit snugly to the bale.

Figure 5:
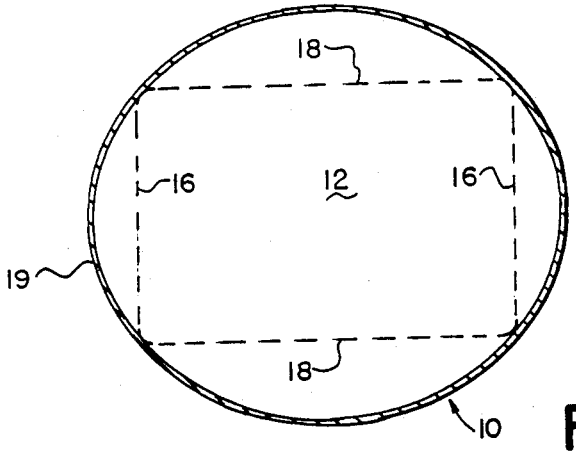
FIG. 5, is a cross sectional view taken on line 5—5 of FIG. 3.
Figure 6:
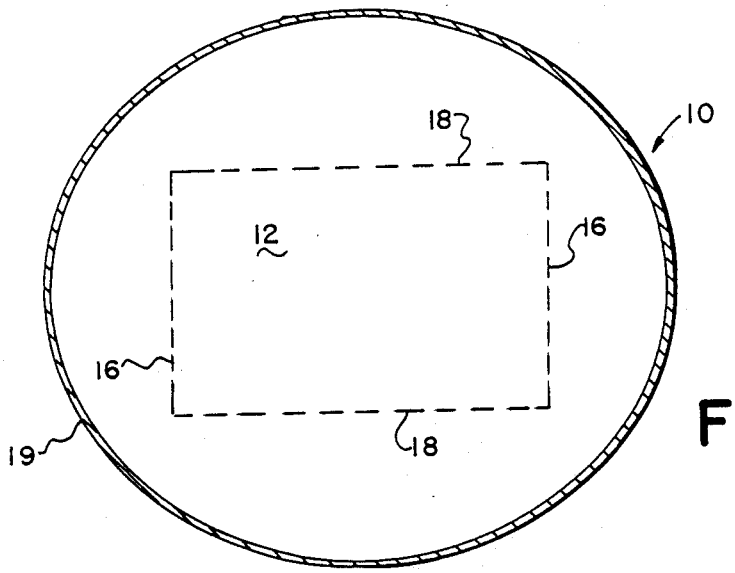
FIG. 6 is a cross sectional view taken on line 6—6 of FIG. 3.
Figure 7:
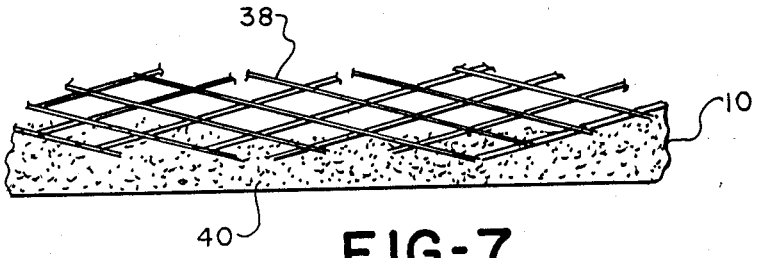
FIG. 7 is a partial view of the cover with some filler material applied to some lathe.

Explaining FIGS. 5 and 6, the bale has been shown having sharp corners. It will be understood that in practice, this would not be so. However, it is drawn this way to illustrate a point, that the top will fit the top of the bale, and since it is a snug fit, it will deform the cover 10 slightly, changing slightly the shape of the cover. Also the bale 12 of cotton is deformed some so that it is slightly more rounded at the top corners. A snug fit at the top of the bale 12 results in an attachment between the cover 10 and the bale so that the cover is prevented from blowing off in extremely high winds.

The top 26 slopes to shed water. From the description of the deformation of the cover 10, and the cover having sufficient stiffness to support the top 26, it will be understood that the cover must have a stiffness, but must also have a flexibility so that it will deform somewhat without cracking. Therefore, it is necessary that the cover is tough so that it will withstand the flexibility without damage and also, any other rough handling it might receive. It is necessary that it be stiff enough to support the top. The cover 10 will be sufficiently larger than a bale 12 so it can readily be handled by mechanical equipment to be placed over the bale and removed from the bale.

Figure 3:
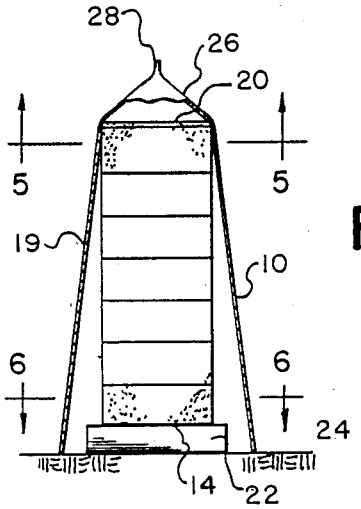
FIG. 3 is a sectional side view of a cover for one bale of cotton.
Figure 4:
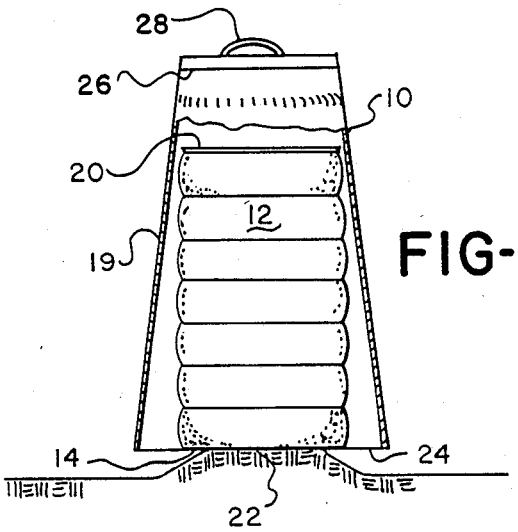
FIG. 4, is a sectional front view of a cover for one bale of cotton.
Figure 2:
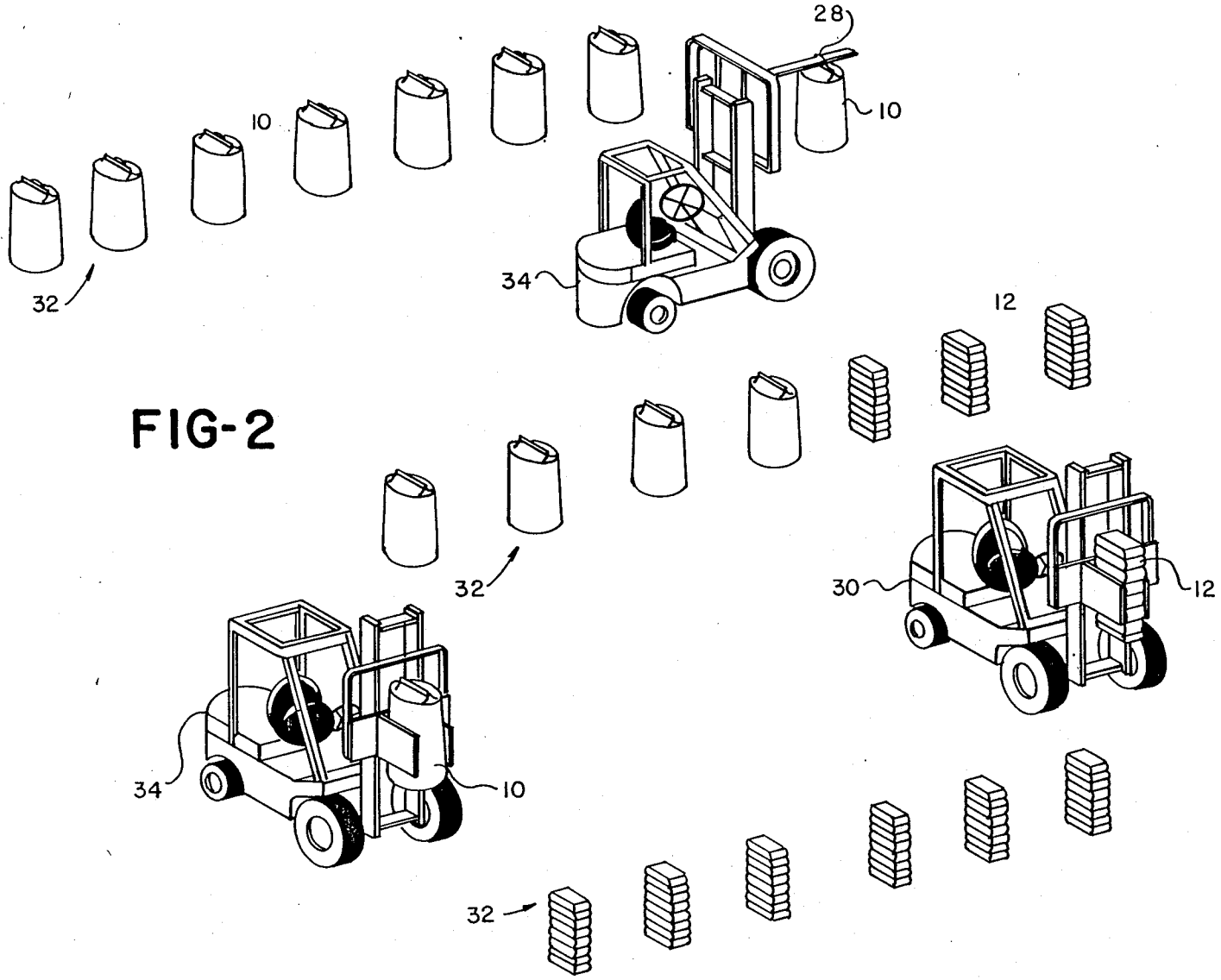
FIG. 2 is a perspective view of a yard with several covered bales of cotton therein.

The bale 12 of cotton will rest upon a support 22 on the ground. Although most common, these are wooden rails, e.g., old railroad ties or the like (FIG. 3). However, in exceedingly arid areas, the support 22 could be an earthen mound, bank, or ridge (FIG. 4). There is a necessity of having a support over the ground, because even in reasonably arid areas, ground moisture, because of its continued contact with the bottom of the bale, will tend to mold and mildew the cotton. The supports could be bars or rails of any other material besides wood.

The cover 10 will have an open bottom 24 and a top 26. It is preferred that the top slop so that rain water and the like will not accumulate on the top of the cover but will be shed from it. Loop or lug 28 will be mounted at the center of the top 26 of cover 10 so that a hook of mechanical equipment could be engaged with it to place it over the bale or lift it from the bale.

The tubular enclosure 19 of the cover 10 tapers from the top 26 outward to the bottom 24 so that when the covers are not in use they may be nested together.

In use, each of the bales of cotton 12 would be brought onto the yard by mechanical equipment 30. Although a clamp lift vehicle has been illustrated in the drawing, it will be understood that it might very well be a truck loaded with cotton and the other type equipment, such as a gin pole, used to lift the bale from the truck and place it in rows 32 upon the yard.

Each bale will have an indicia (not shown) such as a tag bearing a number there upon.

After the bales 12 are placed in rows, a cover 10 is placed over each bale by a vehicle 34. The vehicle 34 might take several forms. It is shown in the drawings as either being a forklift with one of the tines of the fork engaged in the loop 28, or it might be in the form of a clamp lift with the cover 10 clamped in the clamp lift. If the cover were built with sufficient toughness, the same clamp lift that lifts the bales 12 of cotton could be used also to lift the covers. i.e., the clamp lift 30 could first clasp a bale of cotton 12 and set it down then clasp a cover 10 and set it over the bale of cotton.

A cover indicia 36 is placed upon the cover 10. The cover indicia might be in the form of an adhesive label which has a number identical to the number upon the bale indicia. The covered bale of cotton 12 might well set upon its support 14 for a period of months. At the time it is to be moved, the vehicle 34 would move to the desired bale to be moved as indicated by the cover indicia 36, and remove the cover 10. Then the vehicle 30 would move along the row of bales and pick up the bale to be moved and place it upon a truck to be transported to a distant location. The cover 10 having been removed from the bale of cotton could be nested with other covers and stored.

The details of manufacture of the preferred form of the cover 10 is that a framework is made of expanded metal lathe 38. The openings in the lathe are about ⅛". It will be understood the framework could be made of any material so long as the finished structure has sufficient stiffness, toughness, and flexibility. Other examples might be glass fibers, bagasse, jute, bamboo strips, or any other material.

A fireproof and waterproof filler material 40 is sprayed by a spray gun much the same as concrete or "Gunite" is sprayed. The filler material is sprayed to about ¼" thickness. The thickness of the filler material 40 can be greater or less. There are four requirements: one, that it be fireproof or fire resistant; two, that it be waterproof or water resistant so that the excessive water does not leak through and wet the bale of cotton within the cover; three, that it have sufficient stiffness to maintain its shape for placing over the bales of cotton and removing therefrom; and four, that it be tough and flexible enough to withstand rough handling.

The preferred form of the sprayed filler material 40 contains three elements, i.e., aggregate, cement, and polymer. The polymer provides a certain amount of toughness and flexibility.

The preferred aggregate is a pumiceous material; specifically, a pumice of volcanic origin from the acidic or intermediate magma. It will have a cellular structure which has a specific gravity of less than 1.0, i.e., it will float on water It also has E Pumiceous, i.e., pumiceous glass of silicon dioxide. Many other aggregates might be used, including perlite, Fuller's earth (diamatatious earth), vermiculite clay, or amorphous silica.

The second ingredient is portland cement. The portland cement may be either class 1, 2, or 3. It might also be high aluminous (also known as high alumina cement) or a hydraulic cement. s The third ingredient is the polymer material. The preferred form of the polymer is the vinyl acetate polymer. Other polymers which might be used would be of the vinyl chloride acetate copolymer or a water based or water dispersible epoxy or water based polyesters, or water based alkyds.

The preferred form of mixture is:

60 parts of aggregate
40 parts binder

The binder may be either 39 parts portland cement and 1 part polymer or it may be 24 parts portland cement and 16 parts polymer or any proportion therebetween. Stated otherwise, the preferred mixture is one of:

60 parts aggregate
24–39 parts portland cement
1–16 parts polymer

To this is added sufficient water to form a material which can be readily sprayed and adhered to the framework to be used.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A storage yard comprising:

a. a plurality of rows of cotton bales upon the ground, b. each bale having four sides, a top, and a bottom, c. each bale standing erect and spaced apart from the bales on either side thereof.

d. each bale having a stiff, tough, flexible, fireproof, water repellant cover over said bale, and e. an indicia on the cover identifying the bale.

2. The invention as defined in claim 1 wherein said cover of each bale having:

f. a tubular enclosure spaced from and surrounding the bale, g. an open bottom, and h. a sloping top supported by the tubular enclosure.

3. A storage cover for a bale of cotton on a support on the ground comprising, in combination with the above:

a. a tubular enclosure spaced from the lower portion of the bale and surrounding the bale, b. an open bottom, c. a sloping water repellant top supported by the tubular enclosure, and d. said cover being self-supporting, stiff, tough, flexible, and fireproof.

4. The invention as defined in claim 3 wherein said support is wooden rails upon the ground.

5. The invention as defined in claim 3 further comprising:

e. a lifting lug on the top for lifting the cover onto and off of the bale.

6. The invention as defined in claim 3 wherein said tubular enclosure has sufficient stiffness to support the top.

7. The invention as defined in claim 3 wherein said tubular enclosure is water repelling.

8. The invention as defined in claim 3 wherein:

e. said tubular enclosure is tapered.

9. The invention as defined in claim 3 wherein said tubular enclosure is tapered, water repelling, and has sufficient stiffness to support the top.

10. The invention as defined in claim 3 further comprising said cover being a reinforcing material with a filler material thereon.

11. The invention as defined in claim 10 wherein:

e. said filler material is a mixture of an aggregate, a cement, and a polymer.

12. The invention as defined in claim 11 wherein:

f. said tubular enclosure is tapered, water repelling, and has sufficient stiffness to support the top, g. said support is wooden rails upon the ground, and h. a lifting lug is on the top for lifting the cover onto and off of the bale.

* * * * *